United States Patent [19]

Kolk

[11] Patent Number: 4,558,553

[45] Date of Patent: Dec. 17, 1985

[54] FURNITURE ARTICLE WITH EDGE MOLDING

[75] Inventor: Stephen B. Kolk, Grand Rapids, Mich.

[73] Assignee: Steelcase Inc., Grand Rapids, Mich.

[21] Appl. No.: 604,467

[22] Filed: Apr. 27, 1984

[51] Int. Cl.[4] ..... E04C 2/38; E04F 19/02

[52] U.S. Cl. ..... 52/829; 52/716

[58] Field of Search ..... 52/829, 822, 783, 312, 52/716, 821, 830; 428/156

[56] References Cited

U.S. PATENT DOCUMENTS

| | | | |
|---|---|---|---|
| 640,811 | 1/1900 | Reynolds | 52/455 |
| 1,123,450 | 1/1915 | Wheeler | 52/829 X |
| 1,233,497 | 7/1917 | Ohnstrand | 52/784 |
| 1,768,731 | 7/1930 | Awbrey | 52/784 |
| 2,399,666 | 5/1946 | Een | 52/829 X |
| 2,509,037 | 5/1950 | Flicker | 52/830 |
| 2,646,325 | 7/1953 | Abrahamson | 52/829 X |
| 2,840,430 | 6/1958 | Winer | 52/456 |
| 2,879,560 | 3/1959 | Stefan | 52/717 |
| 2,952,496 | 9/1960 | Braal et al. | 52/783 |
| 3,007,213 | 11/1961 | Hobbs | 52/288 |
| 3,335,538 | 8/1967 | Ganzinotti | 52/822 |
| 3,590,754 | 7/1971 | Jakobsen | 108/161 |
| 3,627,251 | 12/1971 | Paulison | 248/345.1 |
| 4,109,981 | 8/1978 | Pfaehler | 52/716 X |
| 4,370,373 | 1/1983 | Janicz | 52/717 |

FOREIGN PATENT DOCUMENTS

| | | | |
|---|---|---|---|
| 720024 | 10/1965 | Canada . | |
| 1029998 | 5/1958 | Fed. Rep. of Germany . | |
| 2219431 | 10/1973 | Fed. Rep. of Germany . | |
| 2749481 | 5/1979 | Fed. Rep. of Germany . | |
| 3002452 | 7/1981 | Fed. Rep. of Germany . | |
| 531294 | 7/1955 | Italy . | |
| 460311 | 9/1968 | Switzerland | 52/829 |

*Primary Examiner*—Alfred C. Perham
*Assistant Examiner*—Jean M. LaKemper
*Attorney, Agent, or Firm*—Price, Heneveld, Huizenga & Cooper

[57] ABSTRACT

The exposed edge of a planar surface of an article of furniture, such as a desk or tabletop, is trimmed with an elastomeric edge molding. Two projections or flanges extend longitudinally along the inner surface of the molding. One projection, a centrally located mounting flange, is inserted into a longitudinal groove cut into the furniture top edge. The molding is securely attached to the furniture top by inserting the mounting flange into the longitudinal groove. The other projection, a locator rib, is located near the edge of the molding which must be flush with the furniture top surface, between that edge and the mounting flange. The locator rib is inserted into a longitudinal groove cut into the furniture top edge. Positioning the locator rib near the molding edge reduces the dimensional tolerances which are inherent in extruded elastomeric moldings. A more uniformly flush surface between the furniture top and the molding can thus be obtained upon the insertion of the locator rib into its corresponding groove. The molding may also have a top lip which extends slightly over the plane of the inner surface of the molding. This lip prevents the formation of gaps between the furniture top edge and the molding.

16 Claims, 5 Drawing Figures

FURNITURE ARTICLE WITH EDGE MOLDING

BACKGROUND OF THE INVENTION

This invention relates to furniture articles incorporating an elastomeric molding of the type used to trim the edges of tabletops, desks tops and the like. Table and desk tops are many times manufactured from particle board, laminated wood or laminated plastics. The edge surfaces of such articles of furniture cannot usually be finished with stain or the like to provide an attractive article of furniture because finishing usually does not hide or cover the exposed lamina of wood or plastic. Consequently, in order to provide an aesthetically pleasing article of furniture, the exposed edge surfaces must be treated in some other manner, typically by trimming the edge with a decorative molding.

Typical of such decorative edge moldings are the so-called elastomeric "T" moldings. These moldings are generally comprised of an elongated strip having a decorative outer face and an inner face to which is attached a single longitudinal mounting flange.

To attach the molding to the article of furniture, the longitudinally extending mounting flange is inserted into a longitudinal groove which is routed into the edge of the desk or tabletop. The mounting flange may have barbs projecting from it which aid in keeping the edge molding in place. U.S. Pat. No. 4,370,373 and 3,590,754 disclose the use of edge moldings having a barbed-type of mounting flange.

A problem with using elastomeric T-moldings is that it is difficult to obtain a flush joint between the furniture top and the molding top. Uneven edges occur because of the large dimensional tolerances that are inherent in the extrusion of elastomeric moldings. Typical dimensional tolerances experienced in present extrusion processes are about plus or minus 5%, which means that an extruded molding one inch wide could have a dimensional variation from the centrally located longitudinal flange to either the top or bottom edge of the molding of as much as 0.050 inch. This thickness is equivalent to the thickness of a single layer of typical plastic top lamination. An uneven joint 0.025 inch above or below the furniture top is typical and readily apparent by sight or touch.

The uneven edges between the furniture top and the molding top are unattractive. In addition, people tend to pick at the rough edges, an activity which further mars the appearance of the molding and at times causes the molding to separate from the furniture edge.

Artisans have tried several different tactics in an attempt to circumvent or solve this problem. One of the more common practices is to simply oversize the edge molding so that it projects beyond the furniture top surface. The projecting portion of molding is then trimmed or sanded to create a continuous surface between the furniture top surface and the top of the molding. This procedure, however, limits the shape of the molding profile and alters the surface finish of the molding. The sanding or trimming shows up glaringly on moldings of thicker cross-section.

Another tactic, which is disclosed in U.S. Pat. No. 2,646,325 to Abrahamson, is to project the top laminate layer(s) of the table slightly beyond the actual edge of the tabletop. This projection then provides an overlapping plate for locating and holding the molding in place.

The third tactic, which merely hides the misalignment problem, is to simply overlap the tabletop surface with a lip on the molding. The lip concealed joint then becomes part of the furniture design.

SUMMARY OF THE INVENTION

The article of furniture of the present invention includes an elastomeric edge molding having, in addition to a flexible mounting flange, a locater rib, also extending longitudinally along the length of the molding. The small locater rib is located near the edge of the molding which must be flush with a furniture surface, between that edge and the mounting flange. The locater rib is inserted into a longitudinal groove cut into the edge of the furniture near the surface which the edge molding is intended to be flush with.

Because the locater rib is located near the edge of the molding, the dimensional variation between it and the edge of the molding will be minimal, i.e., much less than 0.025 inch. Thus, when the locater rib is in place, the top edge of the molding will be more closely aligned with and continuous with the surface of the article of furniture. A flush joint can thus be obtained without having to trim or sand the molding surface or without having to extend the top lamina of the trimmed member past the actual edge.

These and other objects, advantages and features of the invention will be more fully understood and appreciated by reference to the detailed description and appended drawings.

DESCRIPTION OF THE PREFERRED EMBODIMENTS

Figure 1:
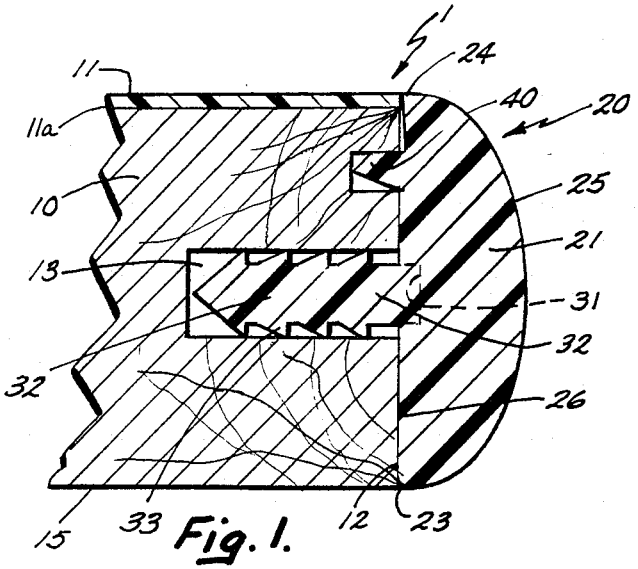
FIG. 1 is a cross-sectional view of an article of furniture of the present invention having an elastomeric molding attached to an edge thereof.
Figure 3:
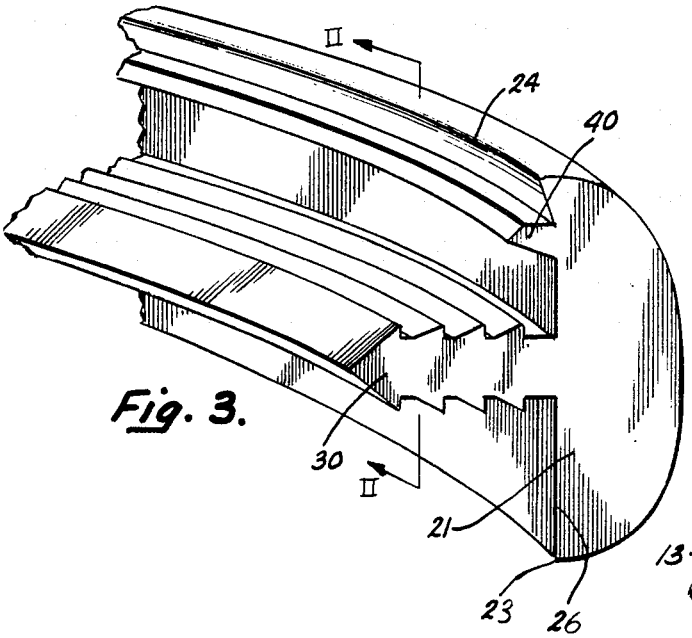
FIG. 3 is a cross-sectional perspective view of the elastomeric molding of the present invention.

In the preferred embodiment, the article of furniture 1 of the present invention includes a top or like surface defining member 10 and a decorative edge molding 20 which is attached to edge 12 of top 10 (FIG. 1). A large mounting flange 30 and a small locater rib 40 extend longitudinally along and project from inner surface 26 of molding 20 (FIG. 3). Mounting flange 30 is received in a first groove 13 located in edge 12 of top 10. Flange 30, when inserted into groove 13, serves to secure molding 20 to edge 12. Locater rib 40, which projects from inner surface 26 of molding 20 near the top edge thereof, is received in a second groove 14 located in edge 12. Locater rib 40, when inserted into groove 14, serves to positively locate molding 20 with respect to edge 12 so that top edge 24 of molding 20 forms a continuous, flush surface with upper surface 11 of top 10.

Top 10 is comprised of an upper surface 11, defined by a laminate layer 11*a*, which can be finished to provide an attractive appearance, an edge 12 to which is attached molding 20, and a bottom surface 15 which is parallel with the upper surface 11 (FIG. 1). Top 10 is typically made of particle board with a laminate upper surface 11*a*. Other materials, such as plastic, could also be used.

Located in edge 12 are two grooves, a large lower groove 13 designed to receive flange 30, and a small upper groove 14 designed to receive rib 40. These grooves are routed in a conventional manner and have a generally rectangular or channel-shaped configuration.

Groove 14 has a depth which is of generally the same length as the length of rib 40 from its leading edge 42 to inner surface 26 of molding 20 and has a width which is of the same dimension as the width of rib 40. Groove 14 is located in edge 12 at a distance below upper surface 11 commensurate with the distance rib 40 is located below top edge 24 of molding 20. This distance is a critical dimension. Groove 14 must be far enough away from upper surface 11 so that it does not affect the structural integrity of the top laminate 11*a*, but it must be close enough to that upper surface so that the dimensional variances in the molding will be undetectable when molding 20 is in place. For example, if a tabletop laminate 11*a* is 0.025 inches thick, then groove 14 will be located approximately 0.15 inch to about 0.20 inch below top surface 11. Routing the groove less than about 0.15 inch below top surface 11 may detrimentally affect the structural integrity of top 10.

Groove 13 is located in edge 12 of top 10 at a distance below upper surface 11 commensurate with the distance that mounting flange 30 is located from top edge 24 of molding 20. Groove 13 is also rectangular in shape. Groove 13 has a depth which is slightly longer than the length of flange 30 and has a width which is slightly smaller than the width of flange 30 at its barbs 33, but which is slightly larger than the width of its base 31.

Molding 20 is comprised of decorative outer surface 25, body 21, top lip 22, bottom lip 23 and inner surface 26 (FIGS. 1 and 3). Typically, molding 20 is extruded of a flexible elastomeric material such as polyvinylchloride. It should be understood, however, that other types of elastomeric material can be used instead of polyvinylchloride. No matter what type of material is used, it should be flexible so that molding 20 can be attached to curving surfaces, such as round tabletops, and so that mounting flange 30, which is co-extruded with molding 20, can bend upwardly or downwardly. The purpose for having a flexible mounting flange will be discussed below.

Molding 20 includes an angled top lip 22 (FIG. 2) which angles inwardly toward edge 12 of top 10. Top lip 22 is defined by an outwardly sloping wall 27, by a top edge 24 of outer surface 25, and by a plane 60 which is a continuation of vertical inner surface wall 26. Inner wall 27 slopes upwardly and inwardly toward edge 12, from the base of locater rib 40 to the point where it intersects with top edge 24. Because inner wall 27 projects slightly toward edge 12 from the base of rib 40, top edge 24 will extend slightly beyond plane 60 of inner surface 26. Further, top edge 24 is essentially perpendicular to plane 60. Wedge-shaped lip 22 prevents the formation of gaps between edge 12 of top 10 and upper edge 24 of molding 30, thereby contributing to the formation of a continuous surface between upper surface 11 of top 10 and top edge 24 of molding 30.

Because the locater rib 40 is located near the upper surface of molding 20, the largest dimensional variance due to extrusion tolerance limitations will be below rib 40. Consequently, when molding 20 is attached to edge 12, any dimensional irregularity is forced downward. Bottom lip 23 thus will not always be flush with bottom surface 15 of top 10. Bottom lip 23 is therefore radiused so as to be less apparent to the touch than a sharp overlapping edge.

Figure 2:
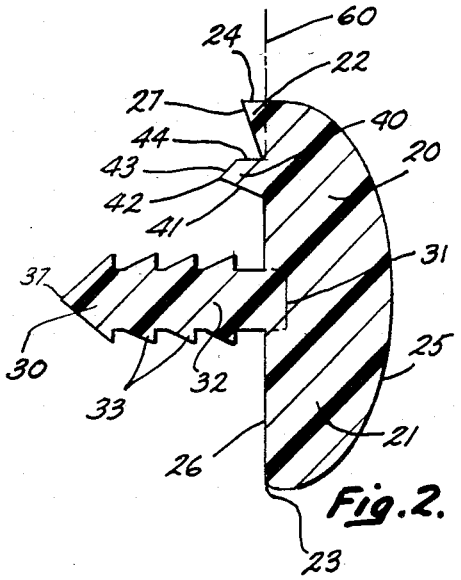
FIG. 2 is a cross-sectional view of the elastomeric molding of the present invention taken along the plane of line II—II of FIG. 3.

Referring to FIGS. 2 and 3, it can be seen that mounting flange 30 extends longitudinally from inner surface 26 of the molding 20. Flange 30 is co-extruded with body 21 of molding 20 and thus it is integrally formed to inner surface 26 at base 31. Flange 30 is typically located midway between top lip 22 and bottom lip 23 of molding 20. Flange 30, since it is formed from the same material as used to manufacture body 21, is slightly flexible, and thus can bend upwardly or downwardly. Base 31 of flange 30 has a width which is less than the width of receiving groove 13. This permits flange 30 to bend upwardly or downwardly when it is inserted into groove 13, as may be necessary to accommodate extrusion tolerance differences (compare FIGS. 1, 4 and 5).

Extending outwardly from base 31 is projecting portion 32 of flange 30. Free end 37 of projecting portion 32 is wedge-shaped so as to facilitate entry into receiving groove 13 (FIG. 2). The upper and lower surfaces of projecting portion 32 are formed with one or more barbs 33. The width of mounting flange 30 at barbs 33 is slightly greater than the width of base 31, and is greater than the width of groove 13 so that a tight friction fit is created between flange 30 and groove 13.

When flange 30 is inserted into receiving groove 13, barbs 33 are partially compressed between the upper and lower walls of the groove. Although flange 30 can be easily inserted into groove 13, the resiliency of the elastomeric material will act to bias barbs 33 tightly against the opposed walls of groove 13, thus serving to securely attach molding 20 to edge 12.

Locater rib 40 extends longitudinally from inner surface 26 of molding 20. Rib 40 is integrally affixed to inner surface 26 of molding 20 at a point between mounting flange 30 and upper edge 24. It is spaced a distance from top edge 24 which is equal to the distance groove 14 is spaced from upper surface 11 of top 10.

Rib 40 of the preferred embodiment has a flat upper side 44 and a chisel-shaped leading edge 42, formed by the intersection of a side 43 which slopes outwardly and downwardly from flat side 44 and side 41 which slopes downwardly towards inner surface 26 of molding 20. Leading edge 42 helps guide locater rib 40 into position in groove 14, and flat upper surface 44 positively locates rib 40 against the upper wall of groove 14. Sloped bottom surface 41 engages the bottom edge of groove 14 to help wedge flat upper surface 44 up against the top wall of groove 14.

After molding 20 is extruded, upper surface 44 and lower surface 41 of rib 40 are machined in order to insure that rib 40 is spaced exactly the same distance from upper edge 24 of molding 20 as groove 14 is spaced from upper surface 11 of furniture top 10. Machining also insures that the width of rib 40 is identical to the width of groove 14.

To assemble the article of furniture, mounting flange 30 is inserted into first groove 13 and locater rib 40 is inserted into receiving groove 14. As mentioned previously, in an inch-wide molding, rib 40 is located from about 0.15 to about 0.20 inches below top edge 24 of molding 20. Therefore, with an expected tolerance of plus or minus five percent (5%), the expected joint unevenness between upper surface 11 and top edge 24 will vary only from about 0.0075 inches to about 0.01 inch, as opposed to a typical unevenness of 0.025 inch, and even this can be largely eliminated by machining as previously mentioned. Thus, top edge 24 of molding 20 will be more uniformly flush with upper surface 11 of top 10. Such a small variation is not easily detectable by the eye or by touch.

Figure 4:
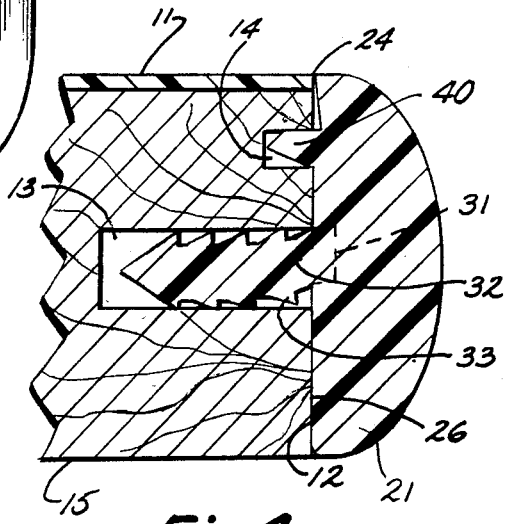
FIGS. 4 and 5 are cross-sectional views of an article of furniture of the present invention illustrating how the mounting flange of the edge molding flexes when the molding is attached to an edge of the article of furniture.
Figure 5:
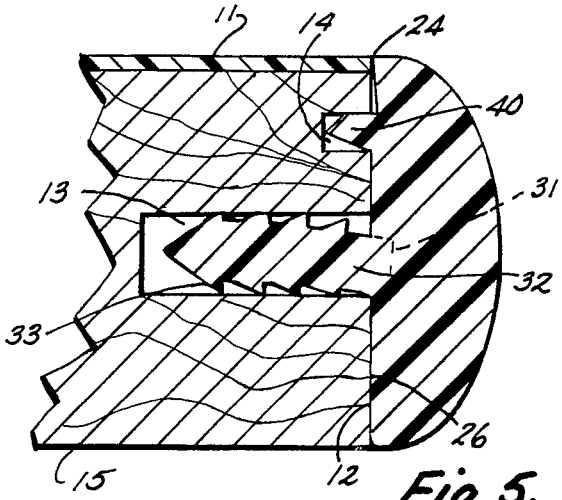

Because of the presence and location of locater rib 40, dimensional variances inherent in such extruded moldings are pushed in a downward direction. Referring to FIGS. 4 and 5, it can be seen that these downward dimensional variances are in large part absorbed by the upward or downward bending of flexible mounting flange 30. For example, when the distance between base 31 and bottom lip 22 is longer than expected, flange 30, upon insertion into groove 13, will bend slightly in an upward direction, thus absorbing, to some extent, the dimensional variances. The radiusing of bottom lip 22 effectively masks the slight variation between bottom surface 15 and bottom lip 22 which will occur. These bottom surface variations are typically not visible and hence not important.

An unexpected advantage of the present invention is that a molding having both a locater rib 40 and a mounting flange 30 protects top 10 from the detrimental effect of moisture. It is believed that rib 40 acts as a valve or barrier to keep moisture from entering edge 12 of top 10. This substantially minimizes edge deterioration of top 10 and helps keep molding 20 tightly in place over a longer period of time.

It is believed that the importance of combining a locater rib 40 with an elastomeric molding 20 having a central mounting flange 30 for the purpose of attaining a continuous, flush surface between upper surface 11 of furniture top 10 and top edge 24 of decorative molding 20 is illustrated by this disclosure. It will also be appreciated that various substitutions and modifications can be made without departing from the spirit and broader aspects of the invention, as set forth more particularly in the appended claims.

The embodiments of the invention in which an exclusive property or privilege is claimed are defined as follows.

1. An improved article of furniture having a surface defining member with a surface and an edge, said edge being finished with an elastomeric molding, said molding having a body with a decorative outer surface and an inner surface, said inner surface terminating at spaced first and second edges of said molding body, wherein said first edge is generally flush with said surface of said surface defining member when said molding is attached to said edge of said surface defining member, and mounting means projecting from said inner surface of said body and matingly engaging with a first groove located in said edge of said surface defining member, said mounting means being sufficiently large in cross-section to provide a secure connection between said molding and said edge of said surface defining member, wherein the improvement comprises in combination:

said mounting means being comprised of a slightly flexible mounting flange having a base portion adjacent said inner surface of said molding body and having a width narrower than the width of said first groove; a projecting portion extending outwardly from said base portion; groove engaging means projecting from said projecting portion for engaging with the sides of said first groove when said mounting flange is inserted therein, said groove engaging means being spaced from said base portion to allow said base portion to flex when said molding is attached to said edge of said surface defining member;

a locater rib projecting from said inner surface of said molding body, near said first edge thereof and spaced from said mounting flange;

a second groove in said edge of said surface defining member for receiving said locater rib, said second groove being located at a distance spaced from said surface of said surface defining member which is commensurate with the distance that said locater rib is spaced from said first edge of said molding body, said locater rib having a width, at least generally adjacent said molding body and for a portion of the distance of its projection from said molding body, commensurate with the width of said second groove whereby there is a snug fit between said locater rib and said second groove;

wherein said rib is inserted into said second groove to positively locate said molding with respect to said surface of said surface defining member such that said first edge of said molding is flush with said surface of said surface defining member, and wherein said mounting flange is inserted into said first groove to positively secure said molding to said edge of said surface defining member, whereby, upon attachment of said molding to said edge, said flexible base portion of said mounting flange bends within said first groove to absorb any dimensional variations occurring in said molding, said locater rib and said mounting flange thereby acting in concert to form and maintain a flush joint between said first edge of said molding and said surface of said surface defining member.

2. An improved article of furniture as recited in claim 1, wherein said locater rib is comprised of a base which is adjacent said inner surface of said molding and a projecting portion which extends outwardly from said base, the end of said projecting portion having a chisel-shaped leading edge to facilitate insertion into said second groove.

3. An improved article of furniture as recited in claim 2 wherein said projecting portion of said locater rib is comprised of three sides, a first generally flat side extending generally perpendicularly from said inner surface of said molding body; a second side extending from the end of said first side and sloping downwardly and outwardly therefrom; and a third side extending from the end of said second side and sloping downwardly and inwardly therefrom to said inner surface of said molding, said three sides defining said chisel shaped leading edge which facilitates the insertion of said rib into said second groove.

4. An improved article of furniture as recited in claim 3 wherein said second edge of said molding body is radiused to form a rounded edge.

5. An improved article of furniture as recited in claim 4, wherein said molding body includes a first lip terminating at said first edge, said first lip being inclined towards said edge of said surface defining member from a point between said base of said locater rib and said first edge of said body, so as to help insure a tight fit between said first edge of said body and said edge of said surface defining member.

6. An improved article of furniture as recited in claim 3, wherein said molding body includes a first lip terminating at said first edge, said first lip being inclined towards said edge of said surface defining member from a point between said base of said locater rib and said first edge of said body, so as to help insure a tight fit between said first edge of said body and said edge of said surface defining member.

7. An improved article of furniture as recited in claim 1 wherein said second edge of said molding body is radiused to form a rounded edge.

8. An improved article of furniture as recited in claim 1, wherein said molding body includes a first lip terminating at said first edge, said first lip being inclined towards said edge of said surface defining member from a point between said locater rib and said first edge of said body, so as to help insure a tight fit between said first edge of said body and said edge of said surface defining member.

9. An improved article of furniture as recited in claims 1, 4 or 6 wherein said locater rib is substantially smaller than said mounting flange.

10. An improved elastomeric molding for use in finishing articles of furniture having a surface defining member with a surface and an edge, said molding having a body with a decorative outer surface and an inner surface, said inner surface terminating at spaced first and second edges of said molding body, wherein said first edge is adapted to be flush with a surface of a surface defining member when said molding is attached to said edge of said surface defining member, and mounting means projecting from said inner surface of said body for matingly engaging with a first groove located in said edge of said surface defining member of said article of furniture, said mounting means being sufficiently large in cross-section to provide a secure connection between said molding and said edge of said surface defining member, wherein the improvement comprises in combination:

said mounting means comprising a slightly flexible mounting flange which projects outwardly from said inner surface of said molding body, said flange including a base portion adjacent said inner surface; a projecting portion extending outwardly from said base portion away from said inner surface of said molding body; and groove engaging means extending outwardly from said projecting portion for engaging with the sides of said first groove when said mounting flange is inserted therein, said groove engaging means being spaced from said base portion, said base portion having a width which is narrower than the width of said groove engaging means to allow said base portion to flex either upwardly or downwardly with respect to a first groove when said flange is inserted therein;

a locater rib projecting from said inner surface of said body, near said first edge thereof and spaced from said mounting means, said locater rib being adapted for insertion into a second groove located in said edge of a surface defining member, at a distance below the upper surface of a surface defining member commensurate with the distance said locater rib is located below said molding body first edge, wherein said locater rib is widest generally adjacent said molding body whereby it will be positively located when inserted into a second groove of comparable width to thereby force said flexible base portion of said mounting flange to bend within a first groove to absorb any dimensional variations occurring in said molding; said locater rib being substantially narrower in width and substantially shorter in projection from said molding body than is said mounting flange whereby it can be inserted into a groove substantially smaller than the groove into which said mounting flange can be inserted; said locater rib being comprised of a base which is adjacent said inner surface of said molding and a projecting portion which extends outwardly from said base, the end of said projecting portion having a chisel-shaped leading edge to facilitate insertion into said second groove.

11. An improved elastomeric molding as recited in claim 10, wherein said projecting portion of said locater rib is comprised of three sides, a first generally flat side extending generally perpendicularly from said inner surface of said molding body; a second side extending from the end of said first side and sloping downwardly and outwardly therefrom; and a third side extending from the end of said second side and sloping downwardly and inwardly therefrom to said inner surface of said molding, said three sides defining said chisel shaped leading edge which facilitates the insertion of said rib into a second groove.

12. An improved elastomeric molding as recited in claim 11 wherein said second edge of said molding body is radiused to form a rounded edge.

13. An improved elastomeric molding as recited in claim 12, wherein said molding body includes a first lip terminating at said first edge, said first lip being inclined away from said inner surface of said body from a point between said base of said locater rib and said first edge of said body, so as to help insure a tight fit between said first edge of said body and said edge of said surface defining member.

14. An improved elastomeric molding as recited in claim 11 wherein said molding body includes a first lip terminating at said first edge, said first lip being inclined towards said edge of said surface defining member from a point between said base of said locater rib and said first edge of said body, so as to help insure a tight fit between said first edge of said body and said edge of said surface defining member.

15. An improved elastomeric molding as recited in claim 10 wherein said second edge of said molding body is radiused to form a rounded edge.

16. An improved elastomeric molding for use in finishing articles of furniture having a surface defining member with a surface and an edge, said molding having a body with a decorative outer surface and an inner surface, said inner surface terminating at spaced first and second edges of said molding body, wherein said first edge is adapted to be flush with a surface of a surface defining member when said molding is attached to said edge of said surface defining member, and mounting means projecting from said inner surface of said body for matingly engaging with a first groove located in said edge of said surface defining member of said article of furniture, said mounting means being sufficiently large in cross-section to provide a secure connection between said molding and said edge of said surface defining member, wherein the improvement comprises in combination:

said mounting means comprising a slightly flexible mounting flange which projects outwardly from said inner surface of said molding body, said flange including a base portion adjacent said inner surface; a projecting portion extending outwardly from said base portion away from said inner surface of said molding body; and groove engaging means extending outwardly from said projecting portion for engaging with the sides of said first groove when said mounting flange is inserted therein, said groove engaging means being spaced from said base portion, said base portion having a width which is narrower than the width of said groove engaging means to allow said base portion to flex either upwardly or downwardly with respect to a first groove when said flange is inserted therein;

a locater rib projecting from said inner surface of said body, near said first edge thereof and spaced from said mounting means, said locater rib being adapted for insertion into a second groove located in said edge of a surface defining member, at a distance below the upper surface of a surface defining member commensurate with the distance said locater rib is located below said molding body first edge, wherein said locater rib is widest generally adjacent said molding body whereby it will be positively located when inserted into a second groove of comparable width to thereby force said flexible base portion of said mounting flange to bend within a first groove to absorb any dimensional variations occurring in said molding; said locater rib being substantially narrower in width and substantially shorter in projection from said molding body than is said mounting flange whereby it can be inserted into a groove substantially smaller than the groove into which said mounting flange can be inserted; said molding body including a first lip terminating at said first edge, said first lip being inclined away from said inner surface of said body from a point between said locater rib and said first edge of said body, so as to help insure a tight fit between said first edge of said body and said edge of said surface defining member.

* * * * *